United States Patent [19]

Cartesse

[11] 4,445,745

[45] May 1, 1984

[54] ELECTRICAL CONNECTORS FOR COAXIAL AND TWO-WIRE CABLES

[75] Inventor: Georges Cartesse, Le Blanc Mesnil, France

[73] Assignee: Societe Generale Pour L'Industrie Electronique (S.O.G.I.E.), Rosny-sous-Bois, France

[21] Appl. No.: 332,712

[22] Filed: Dec. 21, 1981

[30] Foreign Application Priority Data

Dec. 24, 1980 [FR] France ..... 80 27447

[51] Int. Cl.[3] ..... H01R 17/18

[52] U.S. Cl. ..... 339/177 R; 339/276 R

[58] Field of Search ..... 339/177 R, 177 E, 217 S, 339/276 R, 276 C, 276 D, 276 S, 276 F, 276 T

[56] References Cited

U.S. PATENT DOCUMENTS 3,227,993 1/1966 Bentley ..... 339/177 R 3,302,159 1/1967 Schumacher ..... 339/177 R

*Primary Examiner*—Joseph H. McGlynn

*Assistant Examiner*—David L. Pirlot

*Attorney, Agent, or Firm*—Brisebois & Kruger

[57] ABSTRACT

Electrical contact for coaxial cables or two-wire cables of the type having a cylindrical body inside which is mounted a contact piece, the body having in its wall elastic exterior portions able to abut against ledge parts inside a cavity hole of a connector body, the contact being constituted of two joinable assembly components, the first or outside component (1) comprising a cylindrical body supplied on the outside with means for locking (2) in a cavity hole of a connector body, and extended by a rear tubular part (3), and inside which is fastened and insulating sleeve (4), and the second or inside component, comprising a contact piece (5), a connecting barrel (8) for the conductors of the cable, and an insulator (9) interposed between the barrel and the contact piece.

4 Claims, 26 Drawing Figures

1
2
3
4
5
6
7
8
9
IV
IV 1
2
3
4
5
6
7
8
8'
8'a
9
10
11
12
VIII
IX

ELECTRICAL CONNECTORS FOR COAXIAL AND TWO-WIRE CABLES

The present invention relates to electrical contacts especially micro-contacts destined to be fixed to coaxial cables or two-wire cables and to be placed in a cavity hole of a connector body, particularly a multicontact connector. The contacts according to the invention are of the type comprising a cylindrical body at the interior of which is mounted the male or female contact piece, the cylindrical body having in its wall, elastic outer portions, namely struck out tongues, abutting against ledges inside the cavity hole of the connector body to immobilize the contact therein.

Such contacts are usually composed of several components to be assembled by the user when the contact is fastened on the cable. Thus such contacts are known in which the separate components to be assembled are: the cylindrical body having elastic anchor portions, the male or female contact piece, an insulating sleeve designed to be placed between the contact piece and the body and a ferrule designed to allow immobilization of the contact on the cable, particularly by crimping, that is in this case four components. In the case of two-wire cables the contact also usually has an adapter.

It will thus be seen that such contacts require the fabrication, maintenance in stock, and assembly at the site of use of a comparatively large number of components. In view of the very small dimensions of these components which, in practice, are designed for cables whose exterior diameter is on the order of 1 to 3 millimeters, the contacts are relatively complicated to put in place, and in particular, require highly specialized personnel.

In addition contacts are known which consist of a single piece. These contacts have the disadvantage that when they are fastened on the cable by crimping the rear part of the contact, the result is deformation of the insulation, which on the one hand risks deterioration of this latter, and on the other hand leads to problems in electrical connection and mechanical retention.

The present invention proposes to supply a contact avoiding the above-cited disadvantages and also allowing easy and rapid attachment to the cable.

The contact according to the invention is characterized essentially by the fact that it consists of two joinable component assemblies, the first or exterior component having a cylindrical body provided on the outside with means for anchoring in a cavity hole of the connector body, and which is prolonged by a rear tubular part, inside which is fastened an insulating sleeve; and a second or interior component comprising a contact piece, a connection barrel for the cable conductors, and an insulator interposed between the barrel and the contact piece.

Thus for the mounting of a coaxial cable, this latter is fastened, after the end is stripped, by crimping on the second or inside component comprising the contact piece, then this second component is fitted from the rear into the first, the assembly being immobilized by crimping the rear part of the first component.

According to the invention, the first or outside component, described above is identical for two-wire cables and for coaxial cables. It is only necessary to provide one such component of the male contact type and one such component of the female contact type, differing one from the other in the configuration of their front portions.

As to the second or inside component, differences in structure exit between those for two-wire cables and those for coaxial cables as a result of differences in structure of the conductors of the cable to be fastened to this second component. Thus for two-wire cables the barrel of the second component, cylindrical for most of its length, can advantageously comprise in its rear part a section having a flat against which can be applied an unstripped part of one of the conductors of the two-wire cable, the second component comprising, in addition, a sleeve or ferrule encircling the barrel along part of its length. Naturally there are, for each type of cable, second components of the male type and of the female type which differ from each other in the structure of the contact piece, in the form of a male pin in the first case and in the form of a female socket in the second.

Other advantages and characteristics of the invention will appear on reading the following description of particular examples of embodiments with reference to the attached drawings in which.

First reference will be made to FIGS. 1 to 4 which illustrate a contact of the male type, according to the invention, for a coaxial cable.

The contact is shown mounted in a cavity hole of a connector body or block, particularly a multicontact connector. This contact is made by encasing, then assembling, then crimping, as will be described later, of only two components, one shown at FIG. 2, and the other shown at FIG. 3.

Figures 1, 2, 3:
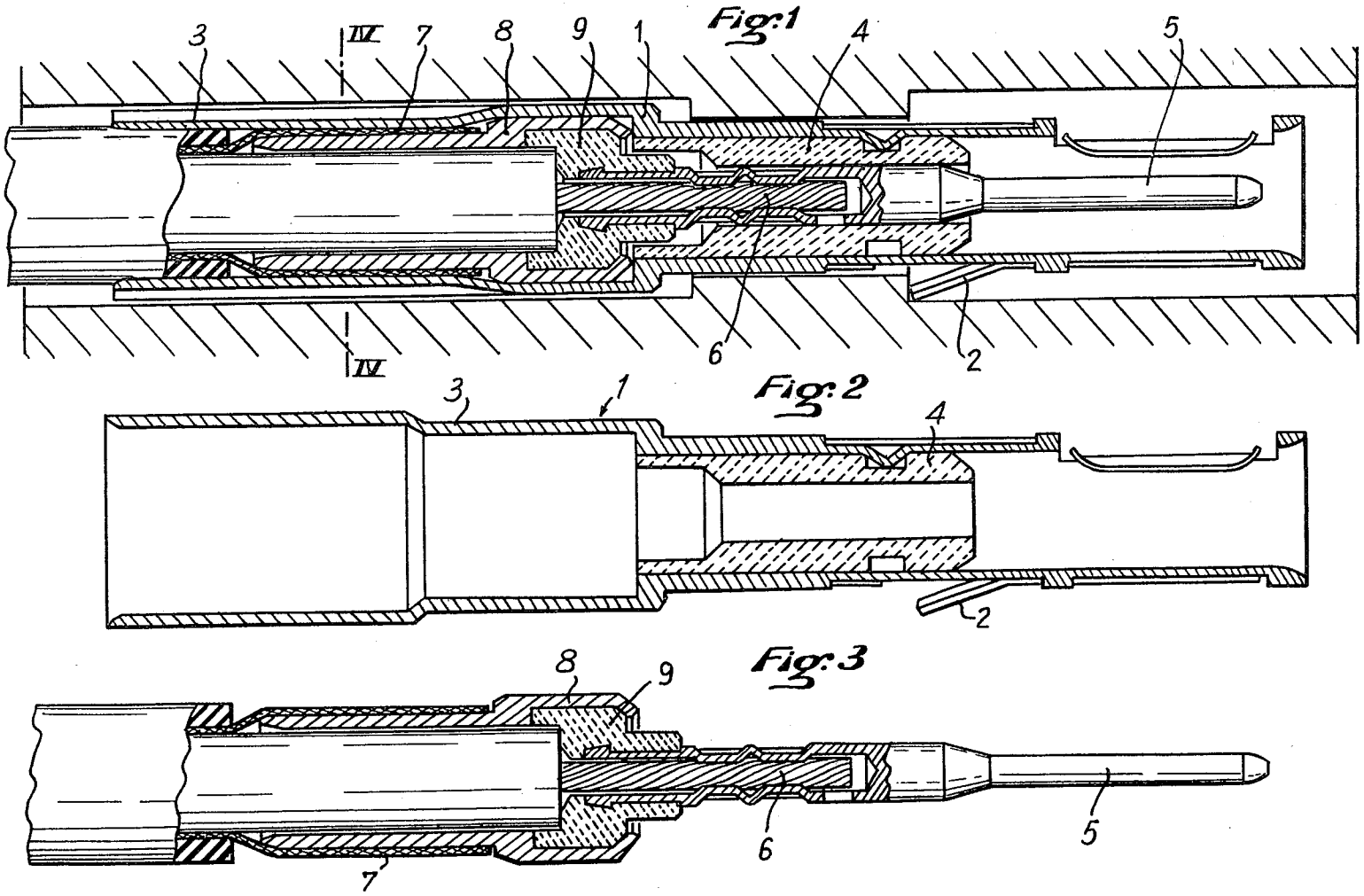
FIG. 1 shows a male contact according to the invention mounted in a cavity hole of a connector block.
FIGS. 2 and 3 show the two components forming the contact shown in FIG. 1.

The first or outside component has a cylindrical body 1 provided on the outside with small tongues 2 forming locking tabs and serving to lock the resulting contact into the cavity hole of the body as shown at FIG. 1.

Body 1 is extended toward the back by a tubular part 3. An insulating sleeve 4 is fastened inside body 1.

The second or inside component, illustrated at FIG. 3, comprises a front contact piece 5, in the present case a male pin contact, to which is fastened by crimping, the stripped end of interior conductor 6 of the coaxial cable. Exterior conductor 7 in the form of a braid of this cable being engaged around a connection barrel 8, constituting with contact piece 5 and an insulator 9, the second component according to the invention.

Figure 10:
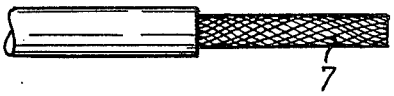
FIGS. 10 to 18 show the different steps in mounting a contact according to the invention on a coaxial cable.
Figure 11:
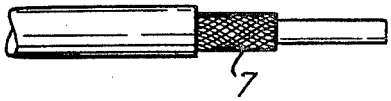
Figure 12:
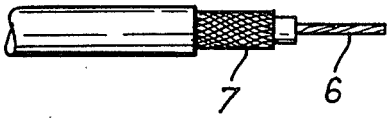

Now the different steps in mounting the contact according to the invention on a coaxial cable will be described with reference to FIGS. 10 to 13. As can be seen at FIG. 10, first the exterior sheath of the cable is removed for a certain distance to expose the metallic braid 7 which constitutes the outer conductor of the cable. Then as shown at FIG. 11 the dielectric separating the interior and exterior conductors of the cable is exposed for a certain distance from the end by cutting back or stripping the braid 7. Then as shown at FIG. 12 the core or interior conductor 6 of the cable is exposed for a certain distance from the end by stripping the dielectric.

Figure 13:
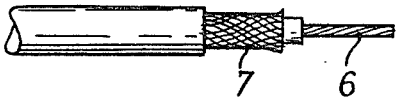
Figure 14:
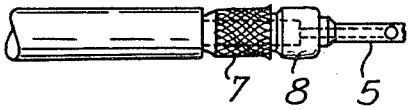
Figure 15:
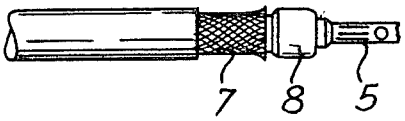

Braid 7 constituting the exterior conductor is then slightly flared, as shown at FIG. 13, then, as shown at FIG. 14, the dielectric and the central conductor 6 are introduced into the second component of the contact according to the invention, after which, as shown at FIG. 15, the interior conductor 6 is crimped in the second component, in the position best seen at FIG. 3.

Figure 16:
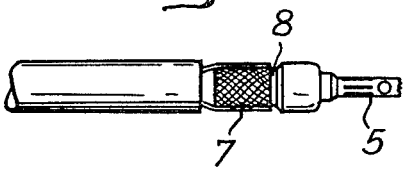
Figure 17:
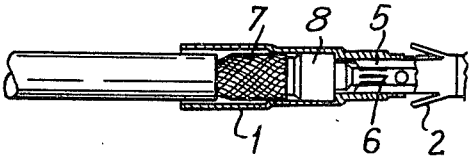
Figure 18:
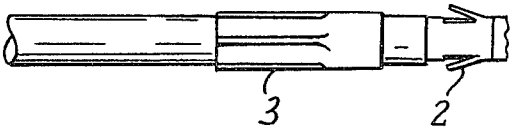

Metallic braid 7 is then pressed down around barrel 8 as shown at FIG. 16 and the assembly is introduced into the first component, as shown at FIG. 17, and finally, as shown at FIG. 18, the rear part of the first component is crimped, immobilizing it on the cable and the second component. The finished contact is best seen at FIG. 1.

Reference will now be made to FIGS. 6 to 9 which illustrate a contact according to the invention which can be used for two-wire cables.

Figure 6:
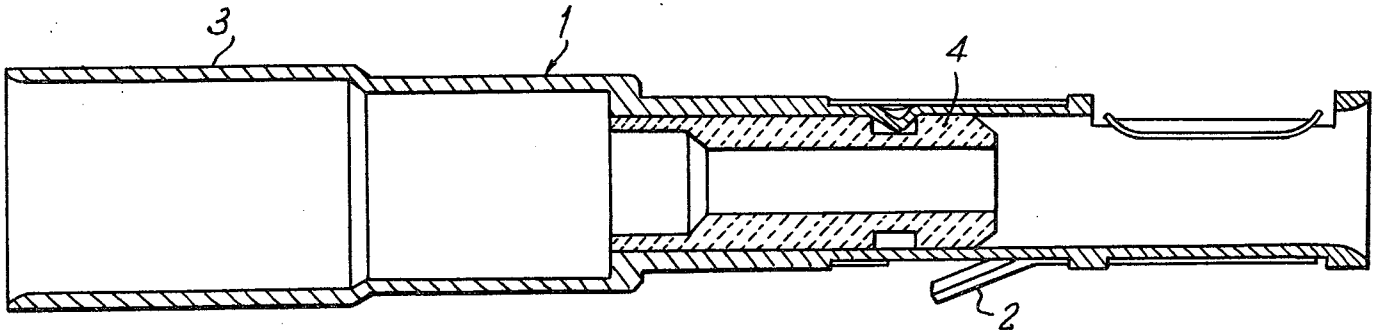
FIGS. 6 and 7 show the two components forming the contact shown at FIG. 5.

As can be seen at FIG. 6 the first component of such a contact is identical to the first component for a coaxial contact shown at FIG. 2.

Figures 4, 5, 8, 9:
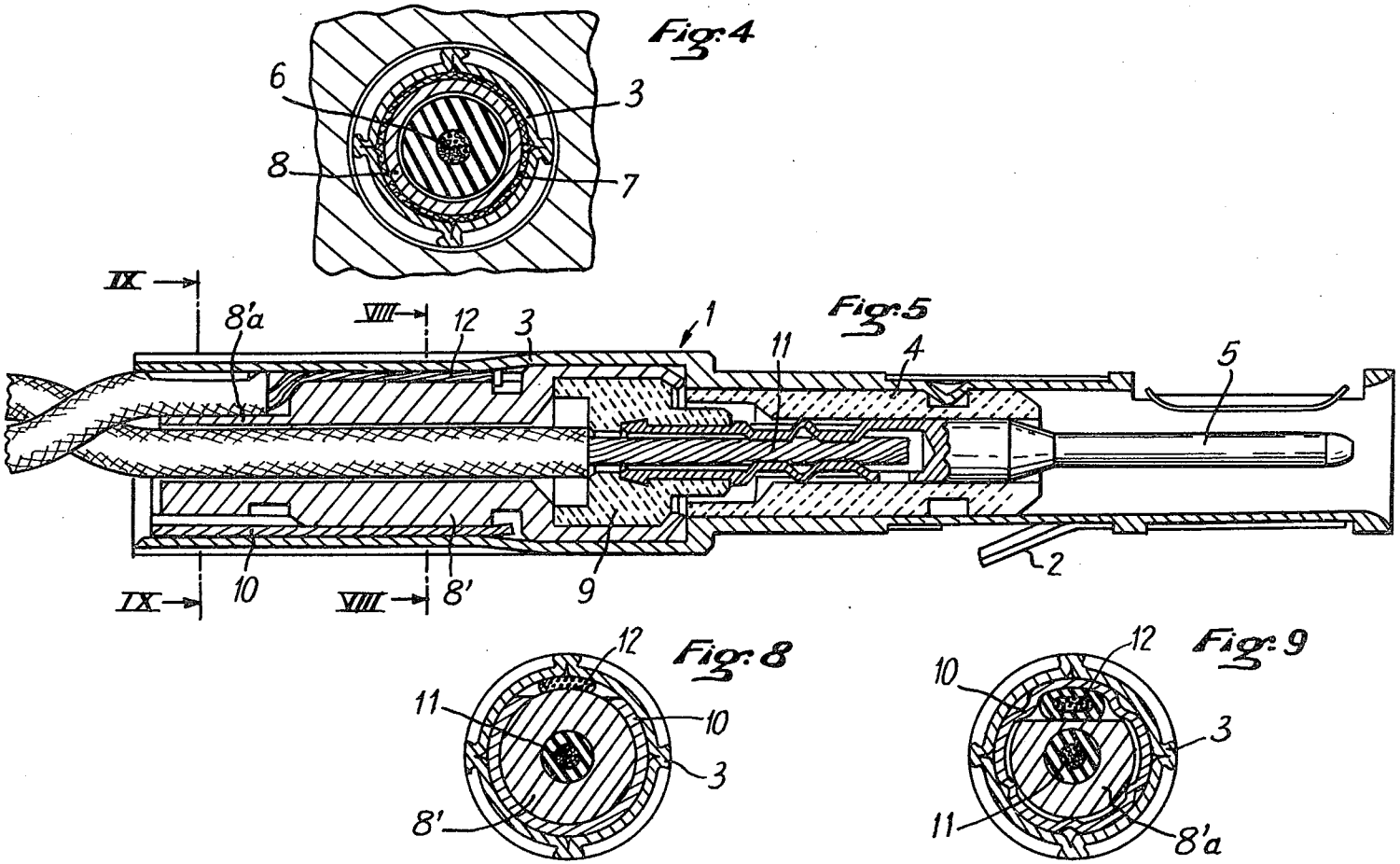
FIG. 4 is a section along line IV'IV of FIG. 1.
FIG. 5 shows a male contact according to the invention mounted on a two-wire cable.
FIG. 8 is a sectional view along line VIII—VIII of FIG. 5.
FIG. 9 is a sectional view along line IX—IX of FIG. 5.
Figure 7:
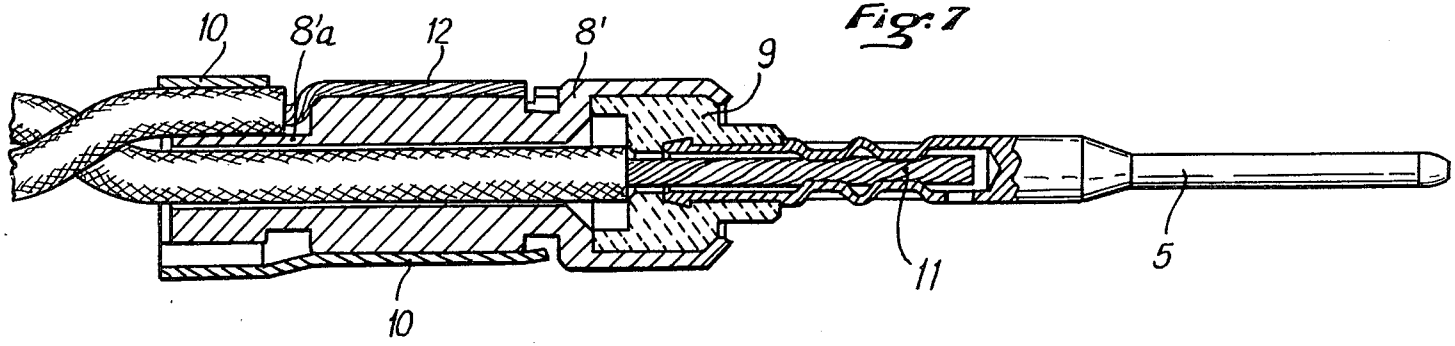

The second component shown on FIG. 7 has a front part identical to that of the component shown at FIG. 3, the contact barrel 8' on the contrary, having a different shap particularly in its rear portion 8'a which has a flat section as can best be seen at FIG. 9. In this embodiment this component also has a ferrule 10 completely surrounding the rear of barrel and surrounding the two conductors of the cable, and having an open side for the rest of its length as appears particularly from examination of FIG. 8.

One of the conductors of cable 11 is placed in the second component of the connector, as shown at FIG. 7, in the same way as interior conductor 6 is in the first embodiment.

The second conductor 12 has its exposed part, as shown on FIG. 5, in contact with barrel 8' of the interior component, and is immobilized between this barrel and body 3 of the exterior component, in the same way as exterior conductor 7 in the first embodiment, by crimping body 3.

Now the fastening of a contact according to the invention on a two-wire cable will be described with particular reference to FIGS. 19 to 26.

Figure 19:
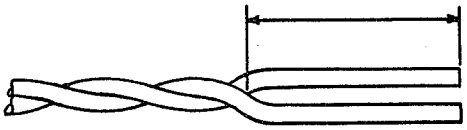
FIGS. 19 to 26 show the different steps in mounting a contact according to the invention on a two-wire cable.

As shown at FIG. 19, the two wires of the cable are untwisted along a certain length, shown by the arrow.

Figure 20:
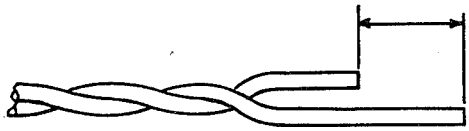
Figure 21:
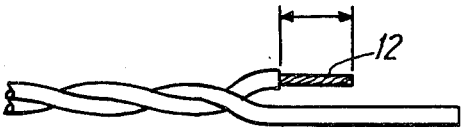
Figure 22:
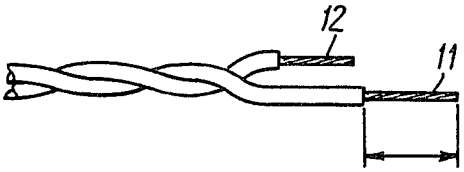

One of the cables is cut, as shown at FIG. 20, and then the conductive core of this wire is bared as shown at FIG. 21. Then, as shown at FIG. 22, the conductive core of the second wire is bared.

Figure 23:
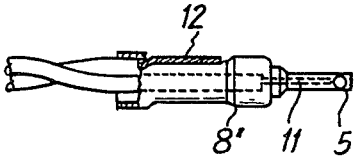

As shown on FIG. 23, the conductive core 11 is introduced into the second component described above of the contact according to the invention, conductive core 12 of the second wire then being positioned against barrel 8'.

Figure 24:
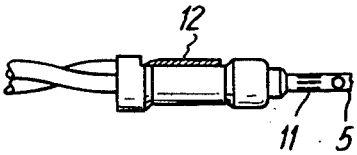
Figure 25:
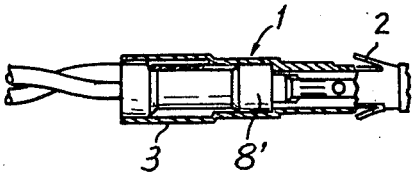
Figure 26:
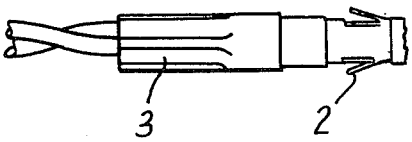

Then, as shown at FIG. 24 the second component is crimped on conductor 11. This arrangement corresponds to FIG. 7.

The assembly thus made is then introduced into the first component and this latter is crimped at its rear part 3, as in the first embodiment, to obtain the finished contact which is best shown at FIG. 5.

All the operations described above are of course identical in the case of contacts of the female type.

Although the invention has been described in connection with particular embodiments it is of course evident that it is no way thereby limited and that numerous variations and modifications can be made to it without exceeding either its scope or its spirit.

I claim:

1. An electrical connector contact for coaxial cables or two-wire cables comprising, an outer pre-assembled assembly comprising a tubular electrically conductive body having a front electrical contact portion with a rearwardly opening sleeve portion, and an insulating sleeve within and fixed to said body, said sleeve portion having an open rearward end and said insulating sleeve being spaced axially from said rearward end, an inner pre-assembled assembly comprising, a contact body having a contact and a socket with an opening facing away from the contact for rearwardly receiving a conductive end of a first wire of a cable, an insulating bushing fixed to said contact body, and an electrically conductive barrel fixed to said insulating bushing in insulated relation to said contact body, said barrel having an open rearward end for receiving therein an insulated portion of the first wire whose conductive end is inserted in the socket of the contact, said barrel including a conductive surface for electrical connection of a second conductor of the cable, said socket of said contact body including means for electrically connecting the conductive end of the first wire inserted therein to the contact, said contact of said inner assembly being a close slidable fit in said outer assembly, and said barrel being receivable in said rearwardly opening sleeve portion of the outer assembly so that said inner assembly can be inserted forwardly into said outer assembly after connecting the cable to the inner assembly, said rearwardly opening sleeve comprising, means for electrically connecting said front electrical contact portion of the outer assembly to the second wire of the cable, and means for mechanically securing the inner assembly against axial separation from the outer assembly.

2. A connector contact according to claim 1, wherein said socket of the contact body of the inner assembly comprises means for electrically connecting the conductive end of the first wire by crimping.

3. A connector contact according to claim 1, wherein said conductive surface of said barrel comprises an outer surface of the barrel.

4. A connector contact according to claim 3, wherein said barrel comprises a recess in its outer surface for the second conductor.

* * * * *